United States Patent [19]

Hilfiker et al.

[11] 4,324,508

[45] Apr. 13, 1982

[54] RETAINING AND REINFORCEMENT SYSTEM METHOD AND APPARATUS FOR EARTHEN FORMATIONS

[75] Inventors: William K. Hilfiker; Harold O. Hilfiker; William B. Hilfiker, all of Eureka, Calif.

[73] Assignee: Hilfiker Pipe Co., Eureka, Calif.

[21] Appl. No.: 110,763

[22] Filed: Jan. 9, 1980

[51] Int. Cl.[3] ..... E02D 5/00

[52] U.S. Cl. ..... 405/284; 405/258

[58] Field of Search ..... 405/258, 263, 272–287; 403/262, 360

[56] References Cited

U.S. PATENT DOCUMENTS

| | | | |
|---|---|---|---|
| 1,762,343 | 6/1930 | Munster . | |
| 3,421,326 | 1/1969 | Vidal . | |
| 3,686,873 | 8/1972 | Vidal | 405/262 |
| 3,922,864 | 12/1975 | Hilfiker . | |
| 3,925,994 | 12/1975 | Broms et al. | 405/258 |
| 4,051,570 | 10/1977 | Hilfiker . | |
| 4,068,482 | 1/1978 | Hilfiker . | |
| 4,116,010 | 9/1978 | Vidal | 405/268 |
| 4,117,686 | 10/1978 | Hilfiker . | |
| 4,273,476 | 6/1981 | Kotulla et al. | 405/284 X |

FOREIGN PATENT DOCUMENTS

| | | | |
|---|---|---|---|
| 2303121 | 10/1976 | France | 405/258 |
| 1485004 | 9/1977 | United Kingdom | 405/284 |

*Primary Examiner*—Dennis L. Taylor

*Attorney, Agent, or Firm*—Naylor, Neal & Uilkema

[57] ABSTRACT

An earthen formation is reinforced against slippage by embedding welded wire grid work mats within the formation and securing the mats to precast elongate panels disposed at the face of the formation. The mats serve as anchors for the panels, as well as reinforcing means for the formation. Plural connections secure the mats along the length of at least certain of the panels.

4 Claims, 19 Drawing Figures

RETAINING AND REINFORCEMENT SYSTEM METHOD AND APPARATUS FOR EARTHEN FORMATIONS

BACKGROUND OF THE INVENTION

The present invention relates to a retention system for earthen formations and, more particularly, is directed to such a system wherein welded wire grid works are embedded in the formation and secured to panels at the face of the formation. In its more specific aspects, the invention is concerned with such a system wherein the mats are secured along the length of the face panels to anchor the panels in aligned stacked relationship.

The use of welded wire mats in retaining systems for earthen formations is taught by U.S. Pat. No. 4,117,686 to William K. Hilfiker, one of the coinventors herein. Such mats are also employed in the retaining system of our copending application Ser. No. 56,826, filed July 12, 1979. In both this patent and application, however, the mats function as face elements, as well as anchoring earth reinforcing elements. In the system of the present invention, the face elements are provided by precast panels and the mats serve to anchor these panels.

U.S. Pat. Nos. 1,762,343 and 3,686,873 disclose retention systems wherein face panels are anchored by means of reinforcing elements embedded in the earthen formation being retained. In the case of U.S. Pat. No. 3,686,873, the reinforcing elements take the form of a plurality of individual relatively narrow straps, each of which straps is secured to a face element at a single point of connection. The anchoring elements of U.S. Pat. No. 1,972,343 are of a relatively narrow ladder-like construction, with each element individually connected to the face panels of the wall for vertical sliding movement relative thereto.

SUMMARY OF THE INVENTION

In the system of the present invention, a plurality of welded wire grid work mats are embedded in the earthen formation to be reinforced. The mats are disposed in vertically spaced generally parallel relationship to one another and elongate precast face panels are disposed at the base of the formation in stacked relationship to one another. Means are provided for securing the face panels in aligned stacked condition and at least certain of the panels are secured along the length thereof to the embedded mats. The elongate connected between the mats and the panels serves to both anchor the panels against displacement and secure the panels in aligned stacked condition. In certain embodiments, the attaching means used to secure the mats to the panels also serve to interconnect the panels.

A principal object of the present invention is to provide a reinforcement system for earthen formations, wherein welded wire grid work mats function to both reinforce the formation and serve as anchors to secure face panels to the formation.

Another object of the invention is to provide such a system wherein the mats are secured to the face panels by elements which serve to interconnect the panels in aligned stacked relationship.

Still another and more specific object of the invention is to provide such a system wherein the mats and face panels have interdigitating connecting means which may be secured together by passing a rod therethrough.

A further object of the invention is to provide such a system wherein the face panels and mats may be prefabricated and delivered to the situs of the earthen formation in a disassembled generally flat condition.

Still another and more general object of the invention is to provide such a system wherein the mats reinforce the earthen formation so as to generally reduce the load imparted to the face panels.

The foregoing and other objects will become more apparent when viewed in light of the following detailed description and accompanying drawings.

DESCRIPTION OF THE FIRST EMBODIMENT

Figure 1:
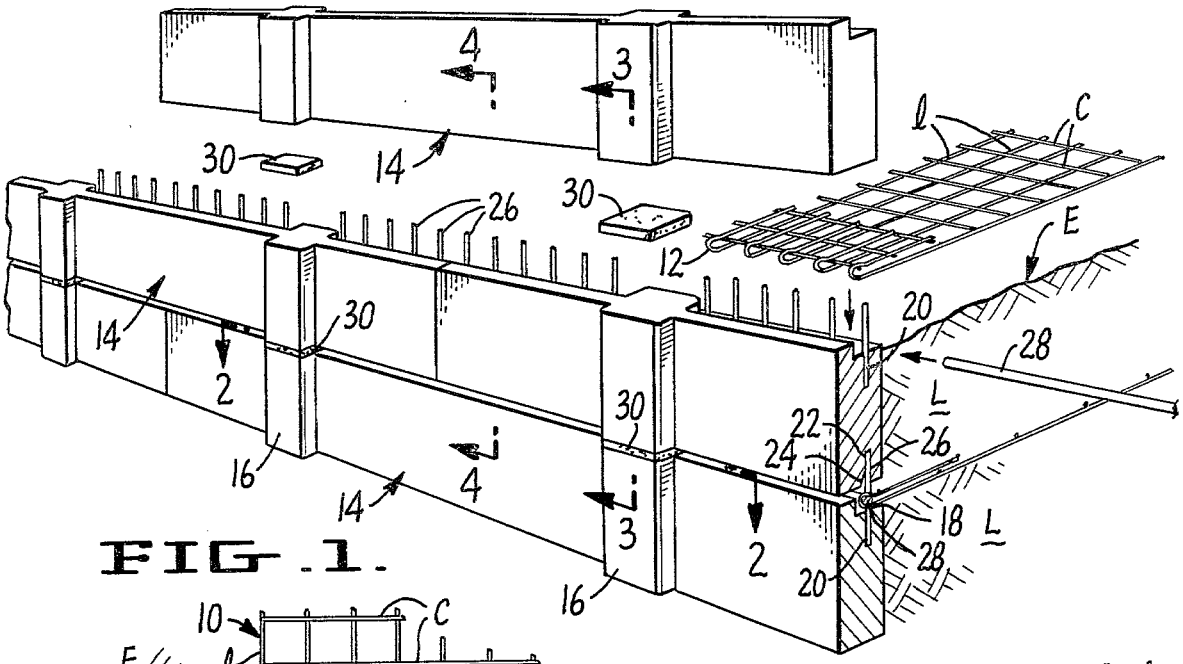
FIG. 1 is an exploded perspective view of an earthen formation retained and reinforced by a system constructed according to a first embodiment of the invention.

Referring to FIG. 1, the earthen formation to be reinforced is designated by the letter "E" and is shown as being divided into horizontal layers "L". The layers "L" typically have a height from two to three feet and have interposed therebetween anchor/reinforcing mats 10. The mats 10 comprise welded wire grid works having elongate longitudinally extending tension rods "l" with cross rods "c" welded thereto and extending transversely thereacross. The cross rods "c" are spaced from one another by from six to 12 inches and longitudinally extending tensions rods "l" are spaced from one another by from two to six inches and welded to the rods "c" at the intersections therewith.

The mats 10 are folded over at the distal ends 12 thereof and, when in place within an earthen formation, the distal ends are positioned to be generally coincident with the face of the formation. In the preferred embodiment, the folded over sections at the distal ends of the members 10 are preformed prior to placement of the mats in an earthen formation.

Figure 5:
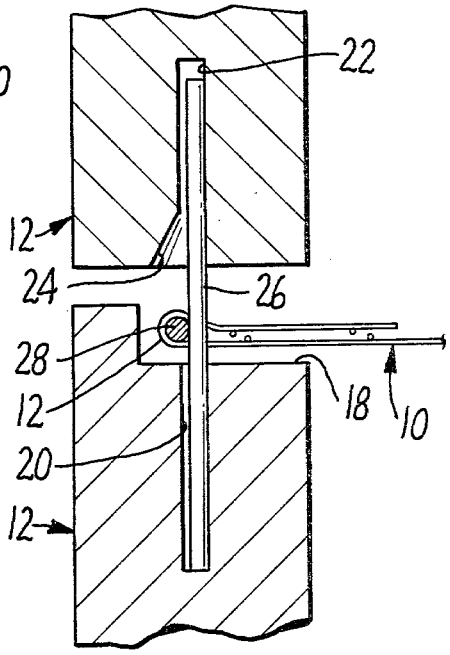
FIG. 5 is an enlarged cross-sectional view, similar to FIG. 4, showing the connection between a pair of the first embodiment face panels and an anchor mat connected thereto.

The face panels of the first embodiment are designated by the numeral 14 and each comprise an elongate precast concrete member having stacking enlargements 16 at spaced intervals therealong and a recessed shoulder 18 formed in the upper surface thereof. Each face panel 14 is also formed with a plurality of upper openings or holes 20 opening through the top surface of the shoulder 18 and a plurality of lower openings or holes 22 opening through the lower surface of the panel. The openings 20 and 22 are formed at uniformly spaced locations along the length of the panels and so disposed as to align when the panels are stacked with the stacking panels 16 thereof in alignment. The openings 22 are formed with forwardly flared mouth sections 24 (see FIG. 5) to facilitate the entry of pin members 26 into the opening. The depth of the shoulder 18 is sufficient to accommodate the folded over distal end of the mat 10 as may be seen from FIG. 5.

Figure 2:
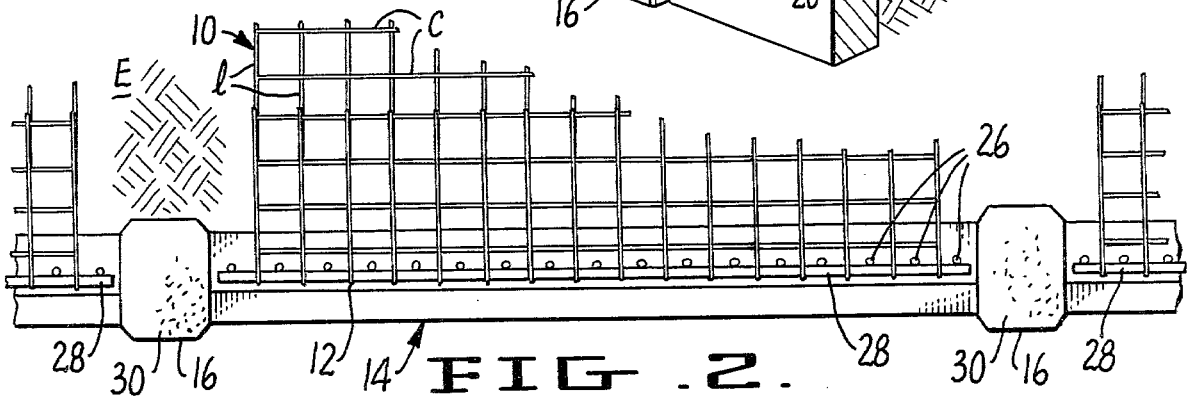
FIGS. 2, 3, and 4 are cross-sectional views taken on the planes designated by lines 2—2, 3—3 and 4—4, respectively, of FIG. 1.
Figure 3:
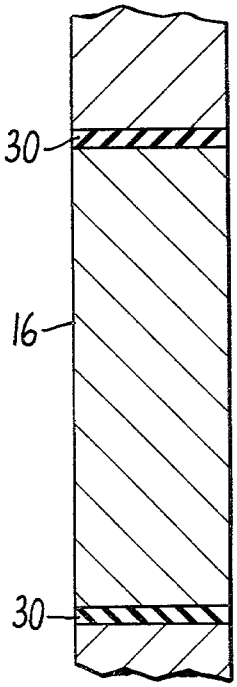
Figure 4:
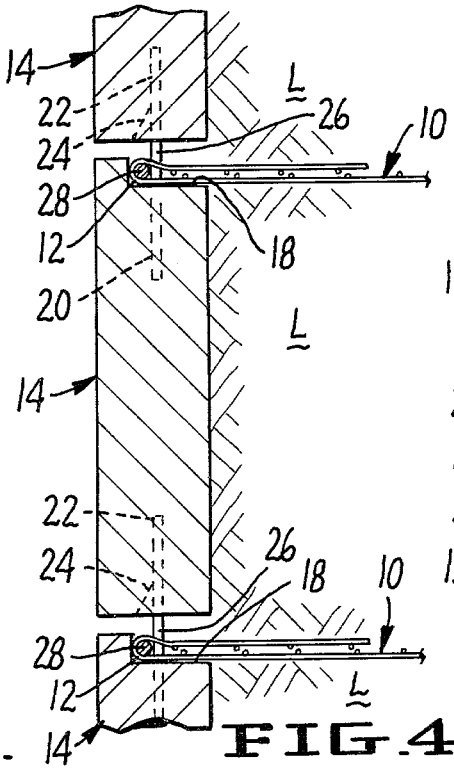

In erecting a retaining system according to the first embodiment, the earthen formation is first excavated to prepare the situs for the wall and then a lowermost row of layer of the face panels 14 is assembled at the base of the formation. Although not illustrated, it should be understood that the foundation may be provided for this first row panels. Once the lowermost row of face panels has been placed, back-fill layer "L" is placed therebehind the mats 10, with rods 28 extending through the looped distal ends thereof, are placed over the fill so that the distal ends 12 are received within the recessed shoulders 18, as may be seen from FIGS. 1 and 2. Thereafter, pin members 26 are extended behind the rods 28 and into the openings 20 and, thus, the mats are secured to the face panels.

Once the lowermost row of face panels has been assembled with the mats thereover and the pin members in place, stacking pads 30 are placed on the stacking enlargements 16 and a second row of face panels is stacked on the lowermost row, with the panels of the respective rows in staggered relationship and the stacking enlargements thereon aligned. Thereafter, back-fill is placed behind the second row and mats 10 are placed thereover with the distal ends 12 thereof received in the recessed shoulders of the second row and pinned in place by pin members 26.

The process of placing successive rows of face panels, together with the back-fill and mats associated therewith, is repeated until the retaining wall reaches the desired height. The mats serve to both anchor the wall provided by the face panels 14 and reinforce the earth-fill behind the wall. The latter reinforcement minimizes the internal load applied to the panel elements by the earthen formation.

It should be appreciated that the pin members 26 serve to both secure the mats to the face panels and maintain the face panels in stacked aligned relationship. Although the pin members have been described as being placed as each successive layer of face panels is positioned, it would be possible to prefabricate the pins in fixed condition within the openings 20 and thereafter thread the mats and successive face panels thereover.

DESCRIPTION OF THE SECOND EMBODIMENT

Figure 6:
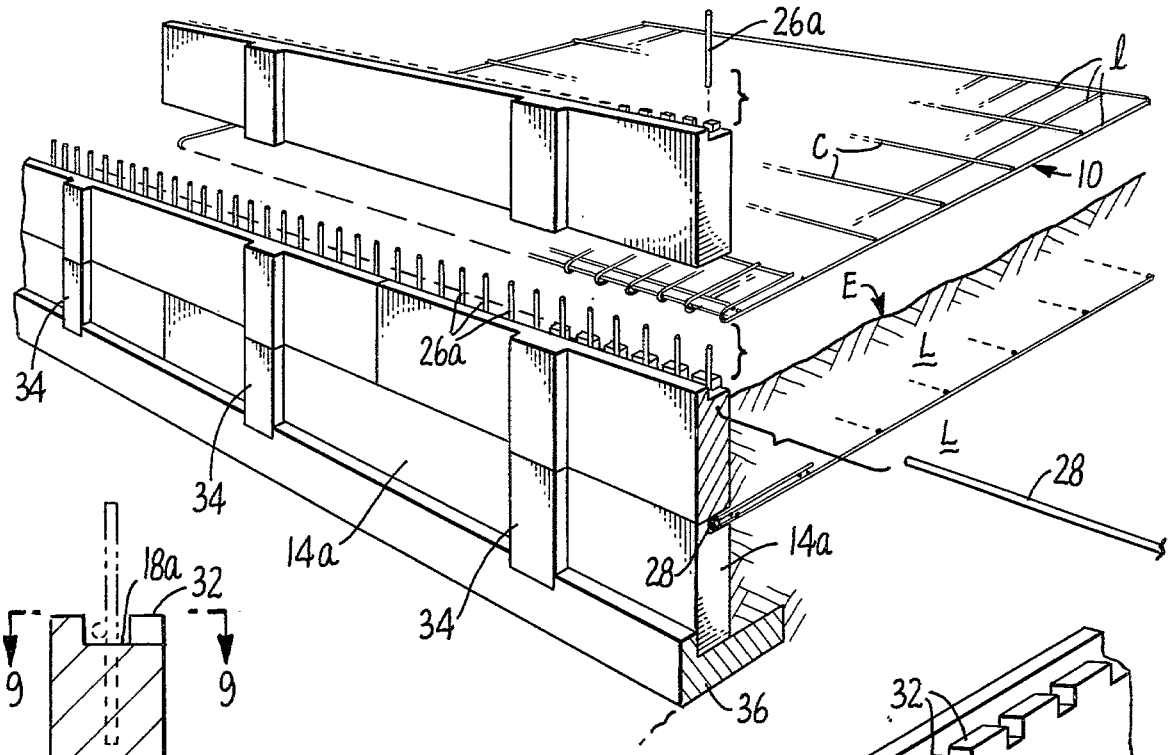
FIG. 6 is an exploded perspective view of an earthen formation retained and reinforced by a system constructed according to a second embodiment of the invention.
Figure 7:
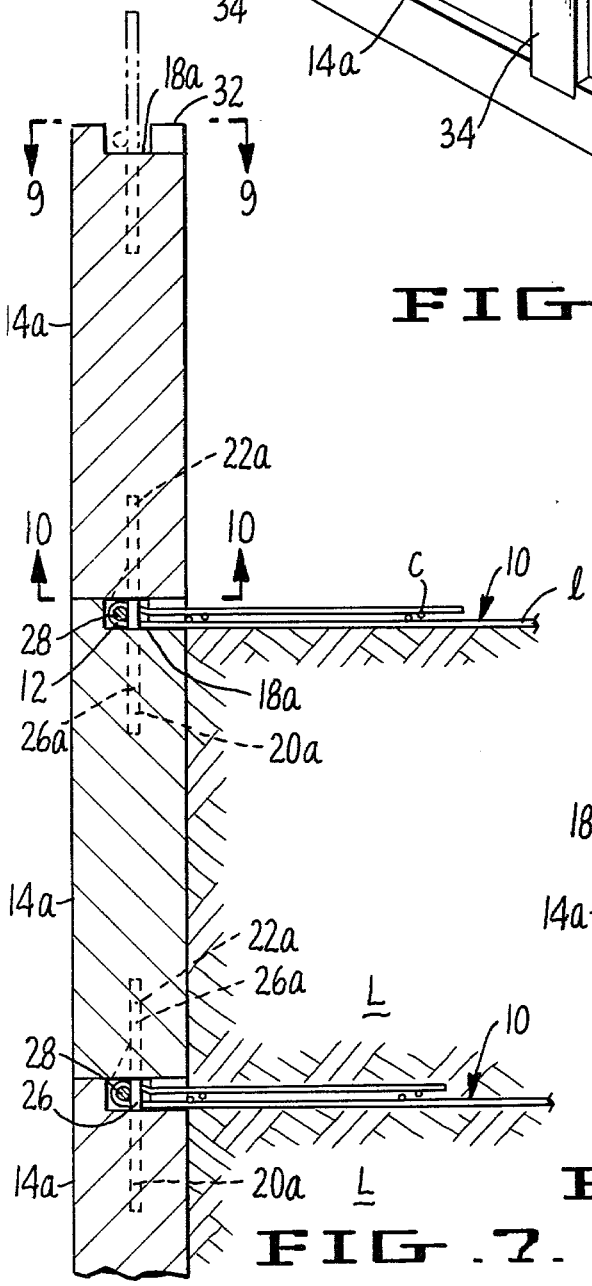
FIG. 7 is a cross-sectional elevational view of the second embodiment system shown in FIG. 6, taken on a plane extending normal to the face panels.
Figure 8:
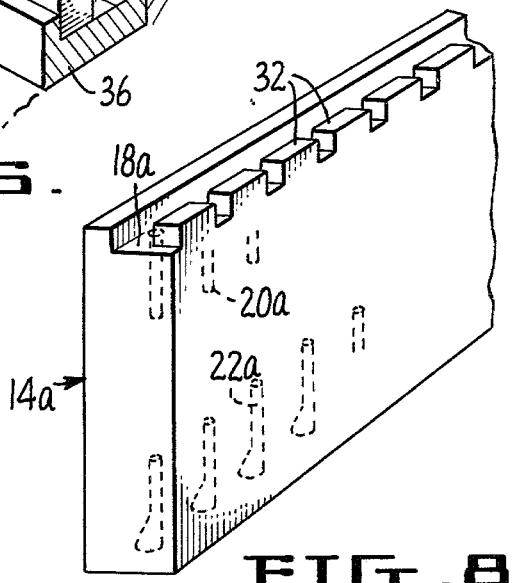
FIG. 8 is a perspective view, with parts thereof broken away, illustrating one of the face panels of the second embodiment system.
Figure 9:
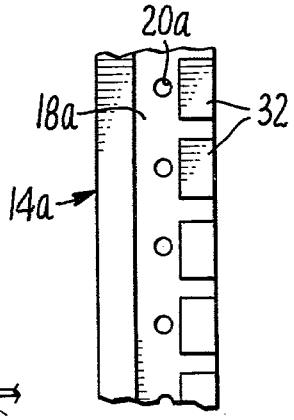
FIGS. 9 and 10 are cross-sectional views taken on the planes designated by lines 9—9 and 10—10, respectively, of FIG. 7.
Figure 10:
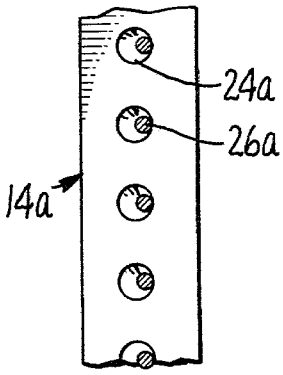

This embodiment, as shown in FIGS. 6 and 10, differs from the first embodiment primarily in that stacking pedestals 32 are formed on the recessed shoulder, designated 18*a*, and stacking enlargements, such as the enlargements 16, are not provided. Although reinforcement enlargements 34 having an external appearance similar to the enlargements provided on the second embodiment, it should be appreciated that the enlargements 34 do not extend rearwardly of the face panels, as do the enlargements 16. Another difference between the first and second embodiments is that the stacking pads 30 are not provided in the second embodiment.

The second embodiment system is erected in essentially the same manner as the first embodiment system, and is comprised of elements corresponding to that of the first embodiment, with the foregoing exceptions. Although the second embodiment is shown in FIG. 6 as being provided with a foundation 36, it should be appreciated that this foundation may or may not be employed, depending upon the circumstances.

The anchor/reinforcing mats of the second embodiment are identical to those of the first embodiment and, accordingly, designated by like numerals and letters 10, 12, "l" and "c". The securing rods 28 of the second embodiment are identical to those of the first embodiment, with the exception that they may be threaded into place after distal ends 12 of the mats 10 are placed on the recessed shoulder 18*a*. This is possible because the enlargements 34 do not interrupt the shoulder 18*a*, as do the enlargements 16.

As shown in FIG. 6, the second embodiment is emplaced in an earthen formation "E", with back-fill layers "L" corresponding to those described in the foregoing discussion with reference to FIG. 1. The face panels of the second embodiment and the elements thereof are designated by numerals corresponding to those used for the first embodiment face panels, followed by the subscript "a" as follows: face panels 14*a*; recessed shoulder 18*a*; upper openings or holes 20*a*; lower openings or holes 22*a*; and mouth sections 24*a*. The pin members of the second embodiment correspond to those of the first embodiment and are designated by the numeral 26*a*.

The second embodiment system may be assembled in a manner corresponding to that of the first embodiment. During the course of this assembly, the folded over ends of the tension rods "l" are received between the stacking pedestals 32 and the distal ends 12 are positioned so as to be disposed to the inside of the pin members 26*a*. Where desired, the rods 28 may be threaded into place after the mats are so positioned.

The composite wall and retaining structure provided by the second embodiment correspond in the mode of operation to that of the first embodiment, with the exception that the stacking loads at the rear side of the panel elements are carried by the stacking pedestals 32, rather than stacking enlargements such as the enlargements 16.

DESCRIPTION OF THE THIRD EMBODIMENT

Figure 12:
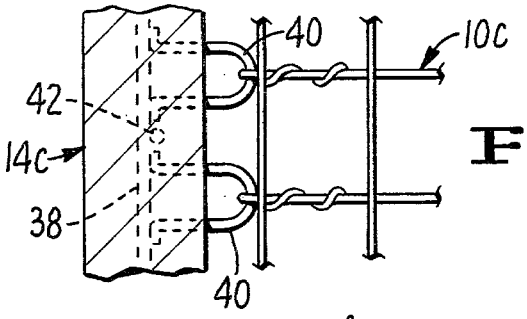
FIG. 12 is a cross-sectional view taken on the plane designated by line 12—12 of FIG. 11.
Figure 11:
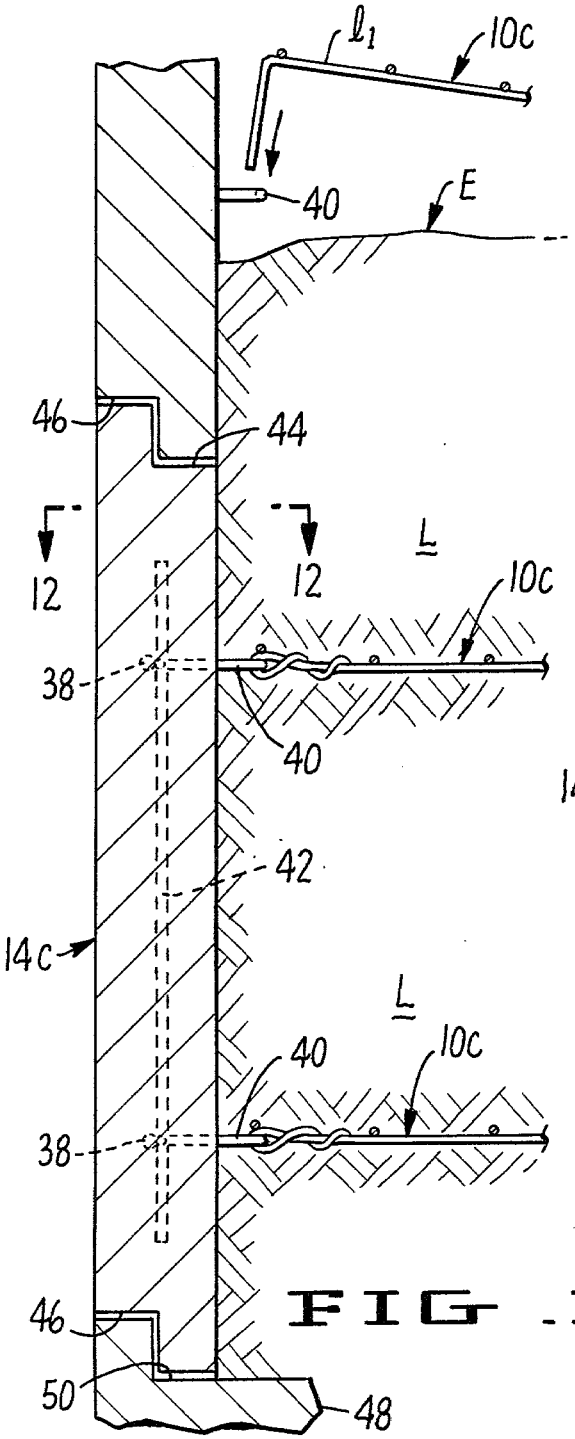
FIG. 11 is a cross-sectional elevational view of an earthen formation reinforced by a system constructed according to a third embodiment of the invention.
Figure 13:
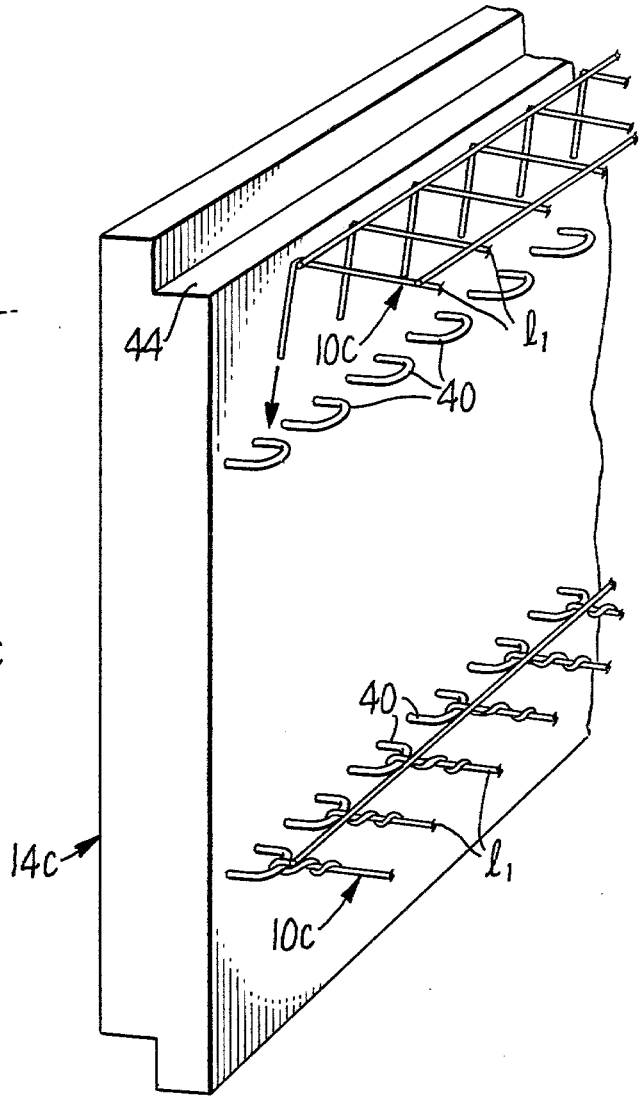
FIG. 13 is a perspective view, with parts thereof broken away, illustrating one of the face panels of the third embodiment, with one anchor mat secured in place and another in the process of being placed.

This embodiment, as shown in FIGS. 11 to 13, differs from that of the first and second embodiment primarily in that the anchoring/reinforcing mats are secured to the back surface of the face panels, rather than received and secured between the stacked panels.

As shown in FIG. 11, the third embodiment system is shown reinforcing and retaining an earthen formation "E" having back-fill layers "L". The elongate face panels of the third embodiment are designated by the numeral **14*c* and each include anchor members cast therein. The anchor members comprise longitudinally extending rods 38; loop elements 40 welded to the rods 38 and extending therefrom through the back surface of the panels to provide vertically extending passages; and, vertical tie rods 42 welded to and extending between the rods 38. The upper and lower edges of the panels 14*c* are formed with shoulders 44 and 46, respectively, which shoulders are designed to be complementally engageable with the shoulders of corresponding panels stacked in engagement therewith to maintain the stacked panels in aligned condition. As shown in FIG. 11, the lowermost panel 14*b* is supported on a foundation 48 and this foundation is provided with a shoulder 50 complementally engaged with the shoulder 46** of the panel to maintain the panel and foundation in alignment.

The anchoring/reinforcing mats of the third embodiment, designated **10*c*, are fabricated of a welded wire grid work similar to the grid work from which the mats 10 of the first and second embodiments are fabricated. The tension rods of the mats 10*c* are designated "$l_1$" and the cross rods welded thereto are designated "$c_1$". The primary difference between the mats 10*c* and the mats 10 is that the distal ends of the tensions rods "$l_1$" are initially bent down at a right angle relative to the body of the mat and, once in place within the loop elements 40**, bent back and twisted around the body of the tension rods.

The third embodiment system is erected in much the same manner as the first and second embodiment systems. During the course of erection, the earthen formation to be retained is first excavated and the lowermost row of face panels **14*b* is then layed at the base of the formation. In the specific embodiment shown in FIG. 11, the foundation 48 is placed in advance of laying of the lowermost row of face panels and then the panels are layed thereabove. After the first row of face panels is in place, the lowermost mats 10*c* are secured to the lowermost row of loop elements 40. The method of securing the mats may be seen from the upper portions of FIGS. 11 and 13, wherein the distal ends of a mat are shown being directed into the vertical passages provided by the loop elements. Once extended through the loop elements, the distal ends of the tension rods are twisted around the body of the rods, as shown in FIG. 12 and the lower portions of FIGS. 11 and 13. Thereafter, the first layer of back-fill "L" is filled over the mat and up to approximately the level of the upper loop elements of the first row of face panels. Mats 10*c* are then secured to the latter row and thereafter the second row of face panels is stacked on top of the first row and the back-fill layer is filled to approximately the level of the lowermost row of loop elements 40 on the second row. Mats 10*c* are then secured to the latter row of loop elements and then back-fill is placed over said mats to approximately the level of the next row of loop elements 40**. Thereafter, mats, back-fill and additional rows of face panels are successively placed until the retaining system reaches the desired height.

Similar to the first and second embodiments, the third embodiment provides a composite wall wherein the earthen formation is reinforced and the face elements are securely anchored in place in aligned stacked condition. Where desired, spacing pads may be interposed between the complementally engaged surfaces of the panels to maintain the rows in slightly spaced relationship and provide a weep space therebetween.

DESCRIPTION OF THE FOURTH EMBODIMENT

Figure 14:
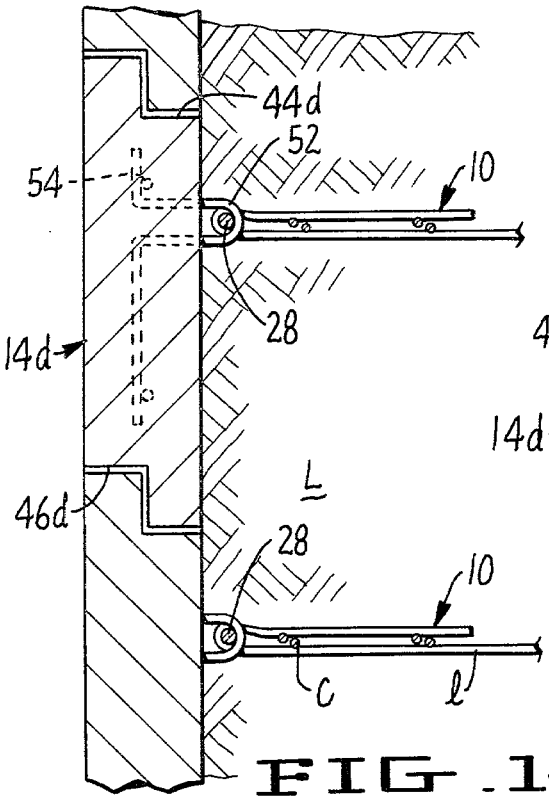
FIG. 14 is an elevational cross-sectional view of an earthen formation retained and reinforced by a system constructed according to a fourth embodiment of the invention.
Figure 15:
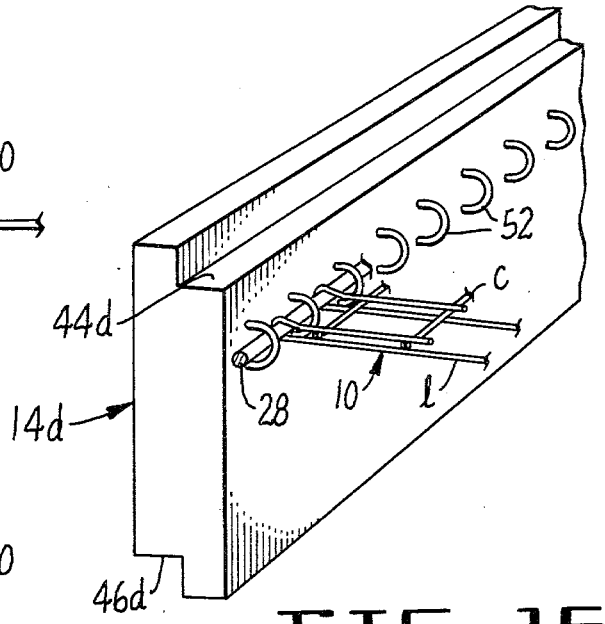
FIG. 15 is a perspective view, with parts thereof broken away, illustrating the face panel element of the fourth embodiment, with an anchor mat secured thereto.
Figure 16:
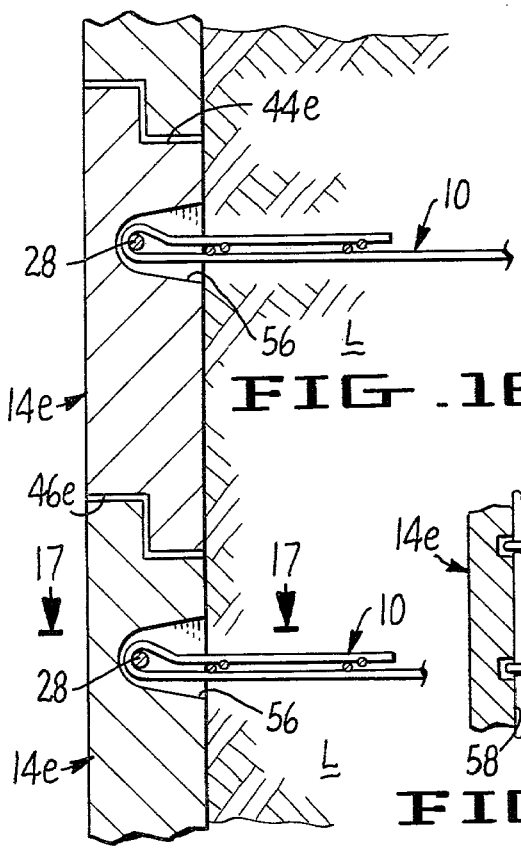
FIG. 16 is a cross-sectional elevational view of an earthen formation retained and reinforced by a system constructed according to a fifth embodiment of the invention.
Figure 18:
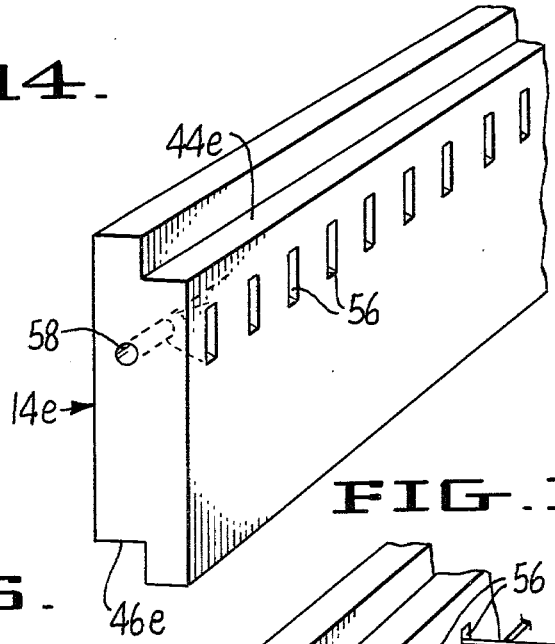
FIG. 18 is a perspective view, with parts thereof broken away, illustrating one of the face panels of the fifth embodiment.
Figure 17:
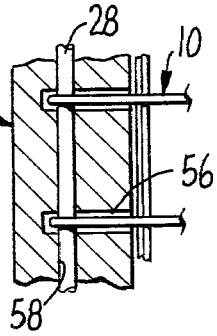
FIG. 17 is a cross-sectional view taken on the plane designated by line 17—17 of FIG. 16.
Figure 19:
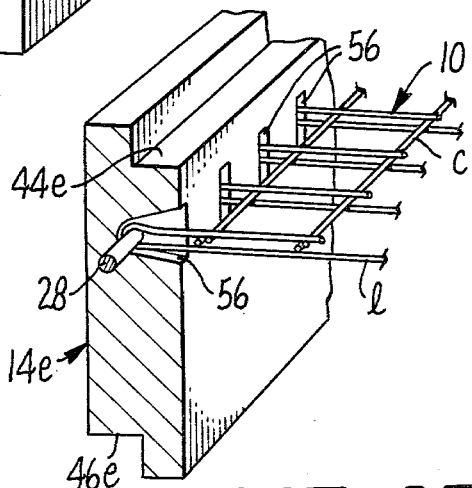
FIG. 19 is a cross-sectional perspective view, with parts thereof broken away, illustrating one of the face panels of the fifth embodiment, with an anchor mat secured thereto.

The fourth embodiment is shown in FIGS. 14 and 15 and is similar to the third embodiment in that it employs face panels wherein anchor loops are cast within the panels and extend rearwardly therefrom. The face panels of the fourth embodiment are designated by the numeral **14*d* and each comprise: a concrete body having an upper shoulder 44*d* and a lower shoulder 46*d*; a plurality of steel loop elements 52 cast within the concrete body in a generally vertical disposition to provide aligned horizontally extending passages; longitudinally extending tie rods 54 welded to and extending across the loop elements to secure the elements together, said rods being cast within the body of the panel. The mats of the fourth embodiment are designated by the numeral 10** and correspond identically to the mats of the first and second embodiments. Each mat comprises longitudinally extending tension rods "l" having cross rods "c" welded thereto and extending thereacross.

The panels **14*d* are designed to be stacked in rows, as may be seen in FIG. 14**. The upper and lower shoulders of the respective rows complementally mate to maintain the rows in alignment. Spacing pads may be interposed between the complementally engaged shoulders to provide a weep space therebetween.

The fourth embodiment system is erected in the same manner as the third embodiment system, with the following exceptions: the mats 10 are secured to the panels **14*d* by rods extended through the looped distal ends of the mats and the passage provided by loop elements 52**; and, only one mat or layer of mats is provided for each face panel. The composite wall provided by the fourth embodiment functions to both reinforce the earthen formation within which it is placed and to provide a securely anchored face wall for the formation.

DESCRIPTION OF THE FIFTH EMBODIMENT

This embodiment is shown in FIGS. 16 to 19 and is similar to the fourth embodiment, with the exception that the anchor structure for securing the mats to the face panels takes the form of recesses and passages formed within the panels, rather than loops extending from the panels. The recesses are designated by the numeral 56 and the passages extending thereacross are designated by the numeral 58. The panels of the fifth embodiment are designated by the numeral **14*e* and each include an upper shoulder 44*e* and a lower shoulder 46*e***, which shoulders are designed to complementally mate with the shoulders of corresponding panels.

The fifth embodiment wall is erected in the manner corresponding identically to the fourth embodiment wall, with the exception that the looped distal ends of the mats 10 are connected to the face elements by extending these ends into the recesses 56 and then passing a rod 28 through the passages 58 to secure the mats in place. The composite wall provided by the fifth embodiment functions to both reinforce the earthen formation being retained and provide a securely anchored face for the formation.

CONCLUSION

From the foregoing detailed description, it is believed apparent that the present invention enables the attainment of the objects initially set forth herein. It should be understood, however, that the invention is not intended to be limited to the specifics of the illustrated embodiment. For example, it is anticipated that situations may arise where it is not necessary to provide anchor mats for each row of face elements. It is also anticipated that, for certain types of substrata, rock anchors might be substituted for certain of the anchor mats.

What is claimed is:

1. A retaining system for an earthen formation, said system comprising: a plurality of elongate precast face panels stacked in generally horizontally disposed relationship to provide a wall, said panels including complementally engageable means to maintain the panels in aligned stacked condition and at least certain of the panels having a recessed shoulder formed in the upper surface thereof and a plurality of pin members extending from the shoulder; anchor mats disposed within the earthen formation behind the stacked face panels, said mats each comprising a plurality of elongate tension rods extending from the panels and a plurality of cross rods welded to and extending transversely of the tension rods in spaced relationship to one another; tension rod extensions on at least certain of said mats extending over and within the confines of the shoulder; and a retention rod carried by the extensions and engaged with the pin members to secure the mats along the length of the panels.

2. A retaining system according to claim 1, wherein the pin members extend into engagement with openings provided therefor in opposed stacked face panels.

3. A retaining system for an earthen formation, said system comprising: a plurality of elongate precast face panels stacked in generally horizontally disposed relationship to provide a wall, said panels including complementally engageable means to maintain the panels in aligned stacked condition and at least certain of the panels having a plurality of pin members extending upwardly therefrom into openings therefor in the panels stacked thereabove; anchor mats disposed within the earthen formation behind the stacked face panels, said mats each comprising a plurality of elongate tension rods extending from the panels and a plurality of cross rods welded to and extending transversely of the tension rods in spaced relationship to one another; tension rod extensions on at least certain of said mats extending over said certain panels; and retention means carried by the extensions and engaged with the pin members to secure the mats along the length of the panels.

4. A retaining system according to claim 3, wherein said pins extend from a recessed shoulder formed in the upper surface of said certain panels and said tension rod extensions extend over and within the confines of the shoulder.

* * * * *